US005816017A

United States Patent [19]

Hunt et al.

[11] Patent Number: 5,816,017

[45] Date of Patent: Oct. 6, 1998

[54] FIRE RETARDANT DOOR AND EXIT DEVICE FOR SAME

[75] Inventors: Larry R. Hunt, Lenoir City, Tenn.; Daniel L. Hibbs, Colby; Mark A. Mason, Amherst Junction, both of Wis.

[73] Assignee: Yale Security Inc., Monroe, N.C.

[21] Appl. No.: 595,786

[22] Filed: Feb. 2, 1996

[51] Int. Cl.[6] ..... A47B 13/08

[52] U.S. Cl. ..... 52/784.11; 52/783.13; 52/232; 292/92; 292/337

[58] Field of Search ..... 52/784.11, 784.15, 52/783.13, 232, 92, 337

[56] References Cited

U.S. PATENT DOCUMENTS

| | | | |
|---|---|---|---|
| 1,721,489 | 7/1929 | Prinzler | 292/21 |
| 2,729,089 | 1/1956 | Pelcin | 70/151 |
| 3,334,500 | 8/1967 | Bejarano | 70/92 |
| 3,751,949 | 8/1973 | Castle | 70/144 |
| 3,953,061 | 4/1976 | Hansen et al. | 292/5 |
| 3,955,330 | 5/1976 | Wendt | 52/232 X |
| 3,964,214 | 6/1976 | Wendt | 52/232 X |
| 3,987,600 | 10/1976 | Baehr | 52/232 X |
| 4,105,482 | 8/1978 | Naslund | 49/399 |
| 4,143,897 | 3/1979 | Bergen | 292/347 |
| 4,246,304 | 1/1981 | Dixon | 52/232 X |
| 4,307,543 | 12/1981 | Schulthess | 52/232 X |
| 4,343,127 | 8/1982 | Greve et al. | 52/232 X |
| 4,489,121 | 12/1984 | Luckanuck | 428/192 |
| 4,583,342 | 4/1986 | Lier | 52/714 |
| 4,637,182 | 1/1987 | Ellsworth et al. | 52/211 |
| 4,661,398 | 4/1987 | Ellis | 428/245 |
| 4,796,931 | 1/1989 | Heid | 292/92 |
| 4,799,349 | 1/1989 | Luckanuck | 52/232 X |
| 4,811,538 | 3/1989 | Lehnert et al. | 52/232 X |
| 4,881,765 | 11/1989 | Heid | 292/92 |
| 4,930,276 | 6/1990 | Bawa et al. | 52/211 |
| 5,020,292 | 6/1991 | Strom et al. | 52/309.9 |
| 5,042,851 | 8/1991 | Hunt | 292/21 |
| 5,114,192 | 5/1992 | Toledo et al. | 292/21 |
| 5,130,184 | 7/1992 | Ellis | 428/245 |
| 5,161,837 | 11/1992 | O'Brien, II | 292/40 |
| 5,355,625 | 10/1994 | Matsuoka | 52/232 X |
| 5,501,045 | 3/1996 | Wexler | 52/232 |

FOREIGN PATENT DOCUMENTS

| | | | |
|---|---|---|---|
| 1175334 | 10/1984 | Canada | 154/84 |
| 2090401 | 1/1972 | France | E06B 5/00 |
| 2384939 | 10/1978 | France | E06B 5/16 |
| 490163 | 8/1938 | United Kingdom . | |

*Primary Examiner*—Yvonne Horton-Richardson
*Attorney, Agent, or Firm*—Moore & Van Allen, PLLC

[57] ABSTRACT

A fire retardant door having a vertical latch stile extending the length of the stile for receiving the elements of a concealed vertical rod exit device therein along with an expanding, fire resistant material, preferably an intumescent compound, for sealing the opening when subjected to heat. The vertically reciprocating exit device rods disposed in the opening are operably connected to bolts disposed in the end of the stile openings, the bolts moveable in response to movement of the vertically reciprocating element from a retracted position within the door edge opening to an extended position to engage the door frame. The composition of the door and arrangement of the exit device elements is selected for a high fire rating, and preferably includes a wooden outer layer provided on each of the major faces of the door. A fire retardant door latch stile for housing the elements of a concealed vertical rod exit device is also provided, the stile defining a vertical opening extending the length of the stile for receiving the exit device elements, and an expanding, fire resistant material, preferably an intumescent compound, is disposed in the stile for sealing the opening when the stile is subjected to heat.

7 Claims, 7 Drawing Sheets

FIRE RETARDANT DOOR AND EXIT DEVICE FOR SAME

BACKGROUND

This invention relates generally to a door, and more particularly concerns a fire retardant door and a concealed exit device for such doors.

A fire retardant door, often referred to as a "fire door," is installed in a building for preventing the passage or spread of fire from one part of the building to another. In the interest of public safety, standards have been set by governmental agencies, building code authorities and insurance companies for the installation and performance of fire door assemblies. The standards require that fire retardant door assemblies be installed in wall openings and that such assemblies pass industry-wide acceptance tests.

Standard test methods for fire door assemblies, such as ASTM E-152, UL 10(b) or NFPA 252, measure the ability of a door assembly to remain in an opening during a fire to retard the passage of the fire and evaluate the fire resistant properties of the door. In conducting such tests, doors are mounted in an opening of a fire proof wall. One side of the door is exposed to a predetermined range of temperatures over a predetermined period of time, followed by the application of a high pressure hose stream that causes the door to erode and provides a thermal shock to the assembly. Doors are given a fire rating based on the duration of the heat exposure of 20 minutes, 30 minutes, 45 minutes, one hour, 1½ hours or three hours. The door assembly receives the fire rating when it remains in the opening for the duration of the fire test and hose stream, within certain limitations of movement and without developing openings through the door either at the core or around the edge material.

To fulfill its purpose, a fire door must be made almost entirely of incombustible material. However, since a fire door is a part of the interior of a living space, it must also be aesthetically pleasing. Usually, therefore, a core of incombustible material comprising the main structure of the fire door is overlain with a thin wood veneer facing that provides the door with an attractive appearance.

Of course, a fire door is normally provided with an exit device. Conventionally, the exit device assembly is required to retain the door closed under normal conditions and prevent surreptitious manipulation and entry by intruders. For fire door applications, the exit device assembly must also maintain the door structure under the high heat and flame conditions of a fire. Such fire conditions can attack the exit device, releasing the bolts or can warp the door, forcing or popping the door open. Possible exit device assemblies for fire door applications include the concealed vertical rod type having at least one bolt selectively projecting from a door edge.

A problem with concealed vertical rod exit devices for use in fire doors is that the assemblies necessarily require an opening longitudinally through the door edge which diminishes the ability of the door to withstand fire conditions. In effect, the opening acts like a chimney or flue during a fire, sucking air, hot gases and flames into the internal portions of the door assembly rendering the door structure susceptible to destruction from the inside. Further, even though the exit device mechanism is internal to the door, there is a direct path for flames and heat to the mechanism. The mechanism can be partially or completely destroyed by the flames and heat presenting the imminent danger of bolt release permitting the door to open and destroying the fire retardant effect of the door.

One solution for mounting concealed vertical door rods within a door in such a manner that the fire retardancy of the door barrier is maintained, has been with the use of full length metal channels on the door edge. The metal channels act as covers for housing the door rods between the frame and the incombustible core of the fire door and for securement of the rods to the core, and as metal edge wraps for enhancing the structural integrity of the door edge housing the vertical door rod therein. Various types of metal channels for use with fire retardant doors have been developed for accommodating concealed exit device assemblies and for trimming the edges of the door on which it is installed. However, when the fire door is itself made of wood, the attractiveness of the door is significantly reduced by the metal channels. The metal must be painted to match or simulate the wood of the fire door facing, requiring a special finish from that applied to the wood. Even so, a metal channel is seldom as attractive as the wood door itself and any slight chipping or abrasion of the painted surface of the metal channel exposes the metal and tends to make the whole door unattractive.

Another disadvantage of the use of concealed vertical rod exit devices in wood fire doors is that the heat transfer rate of the exit device components and the associated metal channel causes the unexposed door face to heat by passing the heat from the exposed face of the door. In a wooden fire door, where at least the door faces are wood veneer, there exists the possibility of either burning the unexposed face or weakening it to the point where it cannot withstand the hose stream, either of which would constitute door failure.

For the foregoing reasons, there is a need for a fire retardant door having a concealed vertical door rod exit device within the channel of the door which is adaptable to appear as natural wood. The door must ensure that the integrity of the exit device assembly engaged with the door frame will be maintained for long periods in the event of the heat destruction of door without the use of metal channels. Further, the door construction must be adaptable to any type of concealed vertical door rod exit device. The door construction must also be convenient and economical to manufacture as well as simply and effectively fitted and mounted using standard carpentry or other conventional type tools.

SUMMARY

The present invention is directed to an apparatus that satisfies these needs. A door having features of the present invention comprises a vertical edge having an opening therethrough adapted for receiving elements of a concealed vertical rod exit device therein and means for sealing the opening when the door is subjected to heat. The sealing means comprises an expanding, fire resistant material and preferably is an intumescent compound. A wooden outer layer is provided on each of the major faces of the door forming a door externally identifiable as a wooden door. The composition of the door is selected to have a high fire rating, at least about 20 minutes and preferably about 90 minutes.

In the present invention, the aforementioned problems are also solved through the provision of a concealed vertical door rod exit device for a fire retardant door comprising a reciprocating rod disposed in the latch edge opening, means for actuating the exit device, and means for sealing the opening when the exit device is subjected to heat. The sealing means comprises an expanding, fire resistant material, such as an intumescent compound, positioned on the rod. The exit device further comprises means for securing the door in the door frame including an extendable latch bolt operably connected to the rod. The latch bolt may include deadlocking means and, where the bolt is of the vertically reciprocating type, means for selectively retaining the bolt in the retracted position are also provided. The exit device actuating means for effecting reciprocal movement of the rod in response to movement of actuating means may comprise a press bar for use as a panic exit device.

Provision in the present invention is also made for a fire retardant door latch stile for housing elements of a concealed vertical rod exit device, the stile defining a vertical opening extending the length of the stile for receiving the exit device elements, and means for sealing the opening when the stile is subjected to heat.

We have discovered that the fire retardant door of the present invention having a concealed vertical rod exit device has achieved fire ratings of 90 minutes without the use of metal channels. Preferably the door has the appearance of natural wood.

Accordingly, it is an object of the present invention to provide a new door for retarding the progress of fire having one or more of the novel features as set forth above or hereinafter shown or described.

A further object of the invention is to provide a fire retardant door which is more attractive than those previously available without detracting from the appearance of the wood veneer which comprises the exterior of the door.

Still further, an object of the present invention is to provide an improved fire door construction wherein the fire barrier and aesthetic requirements are met using a concealed vertical rod exit device.

It is therefore an object of the present invention to provide an alternative to the use of exterior metal channels for concealed vertical rod exit devices without reducing the fire retardancy of the door.

Also, it is an object of the present invention to provide a fire door providing convenient and economical manufacture as well as simple and effective fitting and mounting of the door by use of standard carpentry or other conventional tools.

It is another object of the present invention to provide a new concealed vertical door rod exit device for use in a fire retardant door having one or more of the novel features as set forth above or hereinafter shown or described.

Still another object of this invention is to provide a concealed vertical door rod exit device having particular application for fire retardant doors.

Yet another object of this invention is to provide a concealed vertical door rod assembly for fire retardant doors wherein such assembly is adaptable to any concealed vertical door rod exit device.

A feature of the present invention is means for sealing the latch stile opening during a fire. The sealing means comprises an expanding, fire resistant material which is integrated into the door or exit device assembly so as to close off any openings inwardly through the door stile and into the inner confines of the door when the door is heated.

Another feature of the present invention is the compactness of the exit device components minimizing the required door stile opening for accommodating the vertically operating rod and bolts and maximizing the door insulating material.

A further feature of the present invention is a mechanism whereby the bolt may be latched in retracted position and released into extended position upon door closure.

With the present invention, the mounting of concealed vertical door rods in a fire retardant door can now be accomplished without the use of a metal channel. Accordingly, aesthetically pleasing fire retardant doors, appearing externally to be wooden doors are now possible. The sealing means integrated into the door or exit device assembly prevents the draft effect through the stile channel and into the door safeguarding the internal door and exit device structure. Thus, the integrity of the door and bolt mechanism engaged with the door frame are protected for greater lengths of time in the event of heat exposure of the door. The novel assembly thereby adds to the security of the door and exit device under the described adverse conditions. Moreover, standard concealed vertical door rod exit device components are easily adaptable for use in the present invention.

BRIEF DESCRIPTION OF DRAWINGS

For a more complete understanding of this invention reference should now be had to the embodiments illustrated in greater detail in the accompanying drawings and described below. In the drawings.

DESCRIPTION

Figure 1:
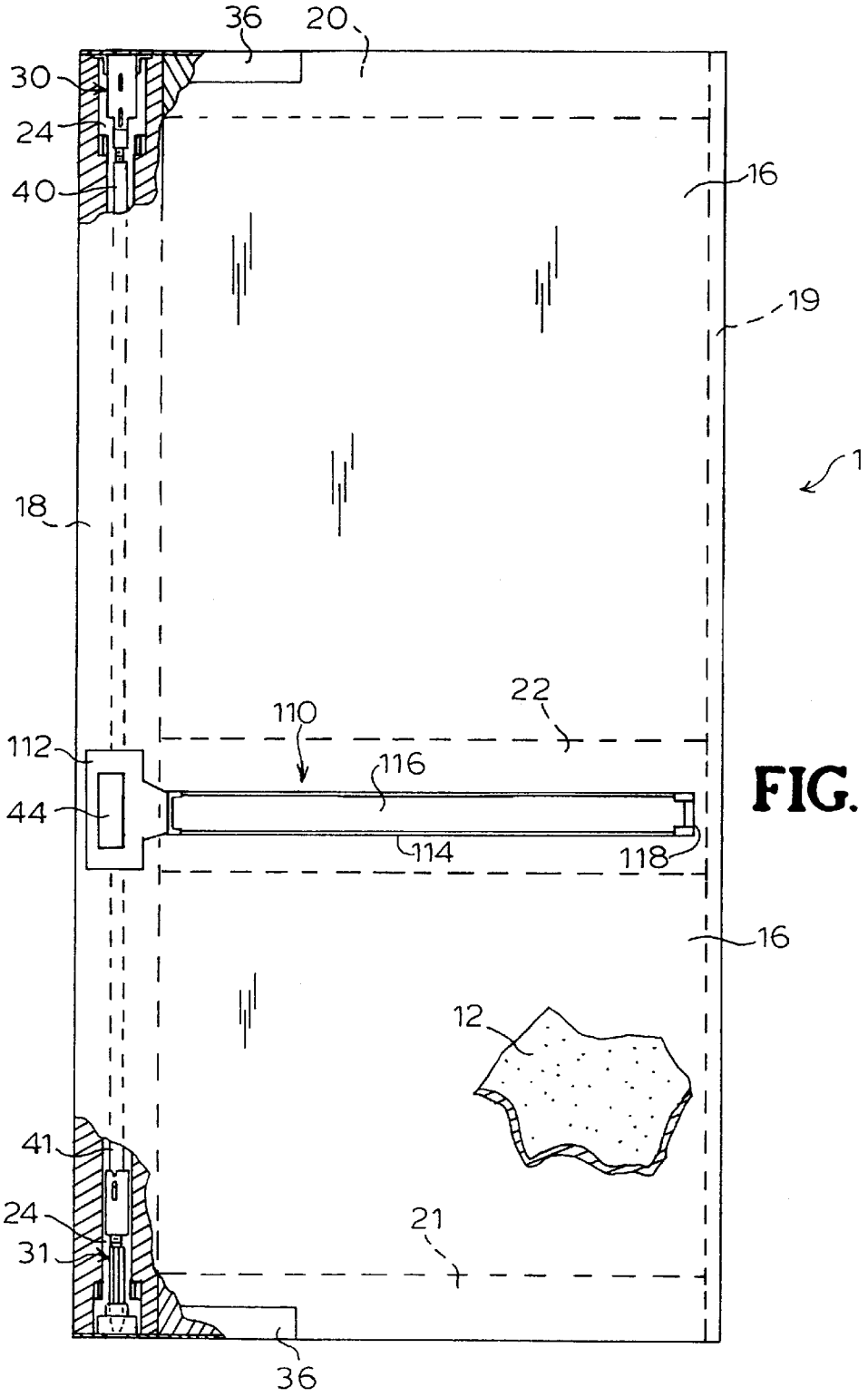
FIG. 1 is a front elevational view shown partly in cross-section of an embodiment of the present invention showing a door and having installed thereon an exit device.

A door including a concealed vertical rod exit device in accordance with the present invention is shown in FIG. 1, and denoted generally by the numeral 1.

Generally speaking, fire retardant doors are manufactured as composite panel products. A typical composite door construction includes three basic components: a core 12; blocking secured adjacent the core 12 edges, the blocking on the vertical door edges referred to as stiles and the blocking on the horizontal door edges as rails; and one or more thin outer facing layers 16 fixedly overlying each of the major door surfaces.

The core 12 comprises the majority of the inner door area. The core 12 may be a continuous, homogenous piece throughout, or may consist of a plurality of pieces arranged to fill the inner door area. The core 12 generally has major opposing surfaces terminating in edges which are substantially perpendicular to the major surfaces of the core 12. The properties desirable in the core material are rigidity, low thermal conductivity, high temperature stability and excellent resistance to thermal shock and erosion by a hose stream. Fire door core materials commonly used include untreated wood or particle board for doors of a low fire rating, such as 20 minutes, or a particle board treated with fire retardant chemicals or a composite mineral core for doors of a high fire rating, such as 45 minutes or more. For example, the preferred core material for use in a high fire rated door in the present invention is a preformed, homogenous mineral composite slab primarily comprising calcium silicate which is manufactured by Weyerhauser, of Marshfield, Wis., U.S.A., and available under the name of Mineral Core. The core 12 is relied upon to provide the door 1 with its fire retardant properties. It is understood, therefore, that the core material for use in accordance with the present invention may be of any suitable composition with the requisite fire retardant characteristics. The core 12 is usually of uniform thickness, which is about 1½ inches, depending on the thickness of the facing 16, as the targeted thickness for the overall door construction is about 1¾ inches.

As noted above, blocking is secured adjacent the core 12 edges. The blocking commonly includes stiles, and can also consist of top and bottom rails 20, 21. The stiles are distinguished as a latch stile 18 and a hinge stile 19 which correspond to the swinging and hinged door stiles, respectively. Blocking 22 may also be located where an exit device 110 actuating mechanism will be placed. The blocking is generally rectangular with the outer edges of the blocking adapted to comprise the outer door 1 edges.

Pursuant to the present invention, the blocking material must be strong, rigid, heat and fire resistant, erosion resistant under a hose stream and have a low heat transfer rate. The fire resistant capabilities of the blocking depends in part upon the amount and type of fire retardant that has been added to the material. Higher fire door ratings are achieved by making the stiles of a particular fire retardant material. Blocking materials suitable for use in the present invention include solid wood, composites, pressed wood fibers or laminates which have been chemically treated to improve fire resistance. One such material is a fire resistant composite known as "No Bolt" blocking which is also available from Weyerhauser. However, while wood and wood-based composites can be used, as more wood is provided as blocking around the periphery of the door 1, the performance of the door deteriorates to the point where it could not withstand fire testing for the required duration to meet the accepted test criteria for a high fire rating. Thus, when a fire rating above 20 minutes is desired, a commercially available fire resistant, insulative composite blocking is especially suitable for use in the present invention. A composite that is satisfactory for this purpose is marketed under the trade name TECTONITE which is manufactured by and available from Warm Springs Composite Products of Warm Springs, Oreg., U.S.A. Similar materials comprising thinner sheets could be used. However, because "Tectonite" and similar products can be purchased in appropriate thicknesses, lamination is unnecessary, thereby offering the ease of manufacture characteristic of single component construction. It is nevertheless understood that the blocking material can be any blocking material approved for fire door applications and which is proven for a particular fire door rating.

The blocking provides structural support and stiffness to the door construction. Accordingly, rails are not always a requisite for doors having a low fire rating. For a 90-minute fire-rated door prepared according to the present invention, rails are preferred for providing additional support to the door 1 for withstanding the extreme fire test conditions for that duration. The blocking 22 positioned for placement of an exit device mechanism 110 thereon, such as a press bar and associated mechanicals, provides rigid structure underneath the mechanism as this location experiences greater stress than other areas of the door 1 during normal use. The blocking further serves to offer door edges that will hold wood screws and normal door hardware therein, such as hinges, an exit device and door latching mechanisms. For example, the composite blocking materials discussed above retain certain of the desirable characteristics of wood, namely the screw holding power and ready workability with carpentry or other conventional tools in the outer edge portion of the blocking elements so that the door is readily trimmed and fitted during installation.

The thickness of the blocking is usually the same as the core 12. Moreover, while the width of the blocking may vary, it is understood that the width is at least such that the dimensional strength of the blocking has sufficient structural integrity and screw holding capacity adequate to meet the demands of securing hinges, exit device and latch constructions for normal use. Notwithstanding, the latch stile 18 width is dictated by the exit device hardware size and location. For a concealed vertical rod exit device, the latch stile is typically at least about four inches wide, and preferably is at least about 4 to about 6 inches wide, and more preferably at least about 6 inches. A latch stile 18 less than about 4 inches in width is not strong enough for the fire door construction. Between about 4 to about 6 inches the ability to locate the hardware is somewhat limited. Above about 6 inches, the stile is sufficiently strong and allows easy location of the hardware. When rails 20, 21 are utilized for higher fire-rated doors in accordance with the present invention, the rails extend to the inner edge of the stiles 18, 19 and are about 5 inches wide.

Figure 2:
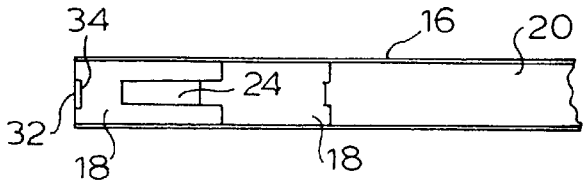
FIG. 2 is top view of the door of FIG. 1 having the exit device removed.

In accordance with the present invention, the latch stile 18 has a longitudinal channel 24 defined therein. The channel 24 may be any shape. For example, in the embodiment shown, the channel 26 is rectangular. The channel may be formed by any number of known machining or drilling methods. When a composite blocking material is used as the material for the latch stile 18, and because it can be purchased in the appropriate thickness, the latch stile 18 can be formed from two pieces. In this arrangement, as shown in FIG. 2, the cooperating edges of the stile 18 have a tongue and groove interengaging relationship such that when the two pieces are put together the channel 24 is defined in the assembled stile 18. The channel 24 accepts the hardware of the concealed vertical rod exit device. Ideally, the cross-sectional area of the channel 24 is as narrow as possible while still allowing for passage and movement of the exit device hardware therein. For example, the rectangular channel 24 shown measures about ⅞ inches across the width of the door by about ⅝ inches through the face of the door. The centerline of the channel is about 2 1/16 inches from the edge of the door. At the top and bottom of the latch stile, the channel 24 widens to about 1⅞ inches forming pockets to accommodate the top and bottom latch assemblies 30, 31. The top pocket 26 extends about 6⅞ inches vertically downward into the door. The bottom pocket 27 extends about 2⅛ inches vertically upward into the door.

Figure 3:
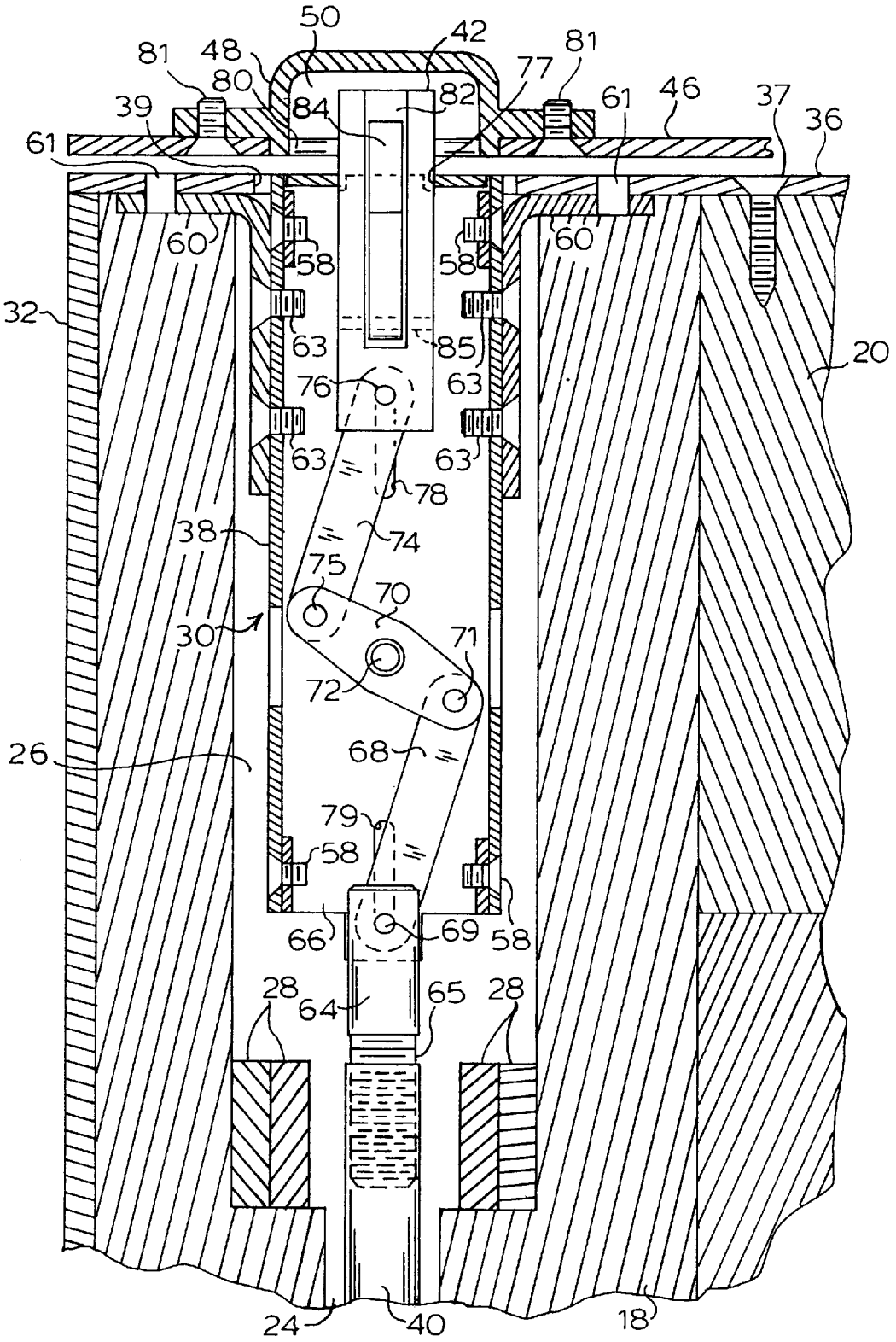
FIG. 3 is a front sectional view of an embodiment of a latch for use in the present invention.
Figure 5:
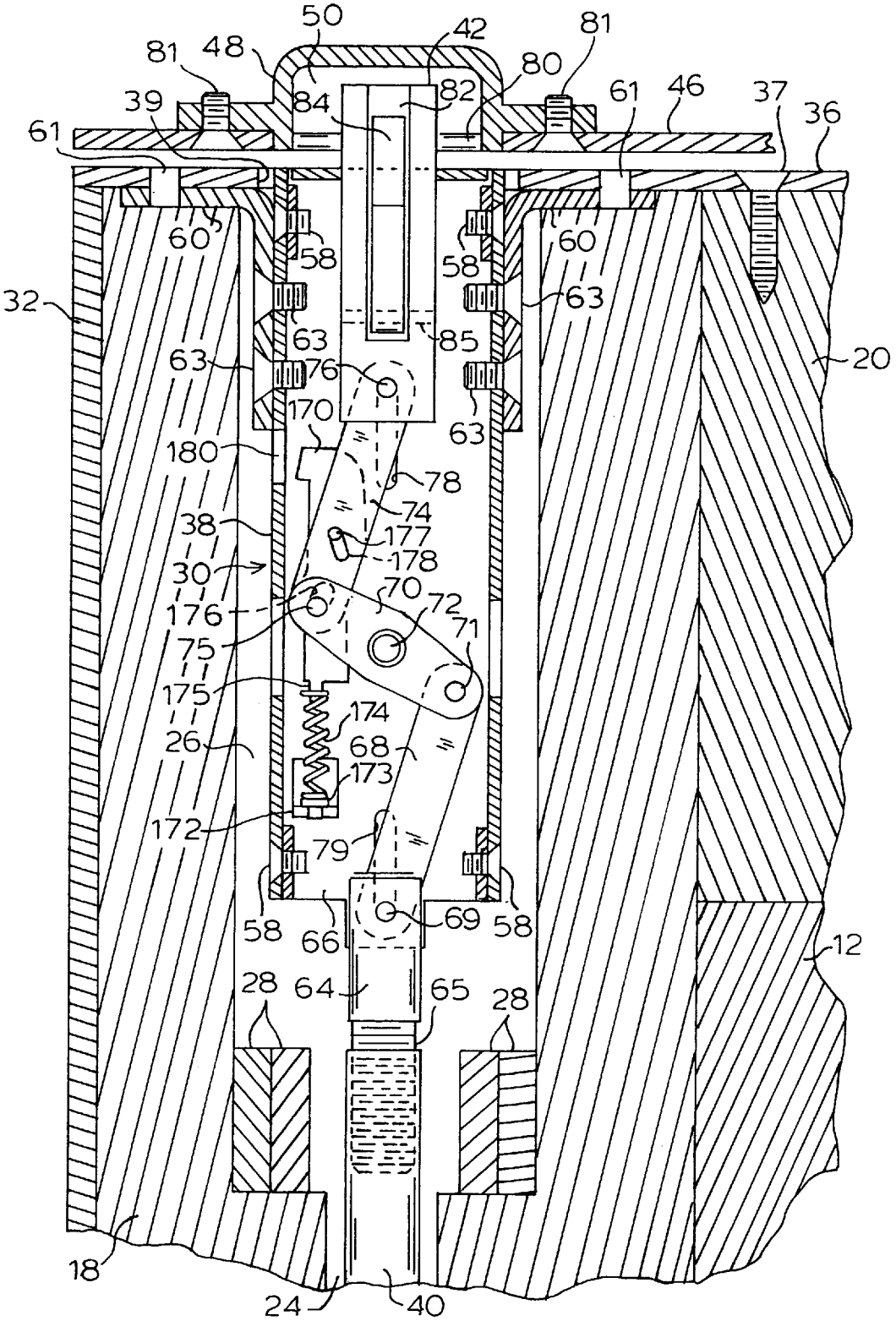
FIG. 5 is a front sectional view of an embodiment of a latch including a deadlocking feature for use in the present invention.
Figure 8:
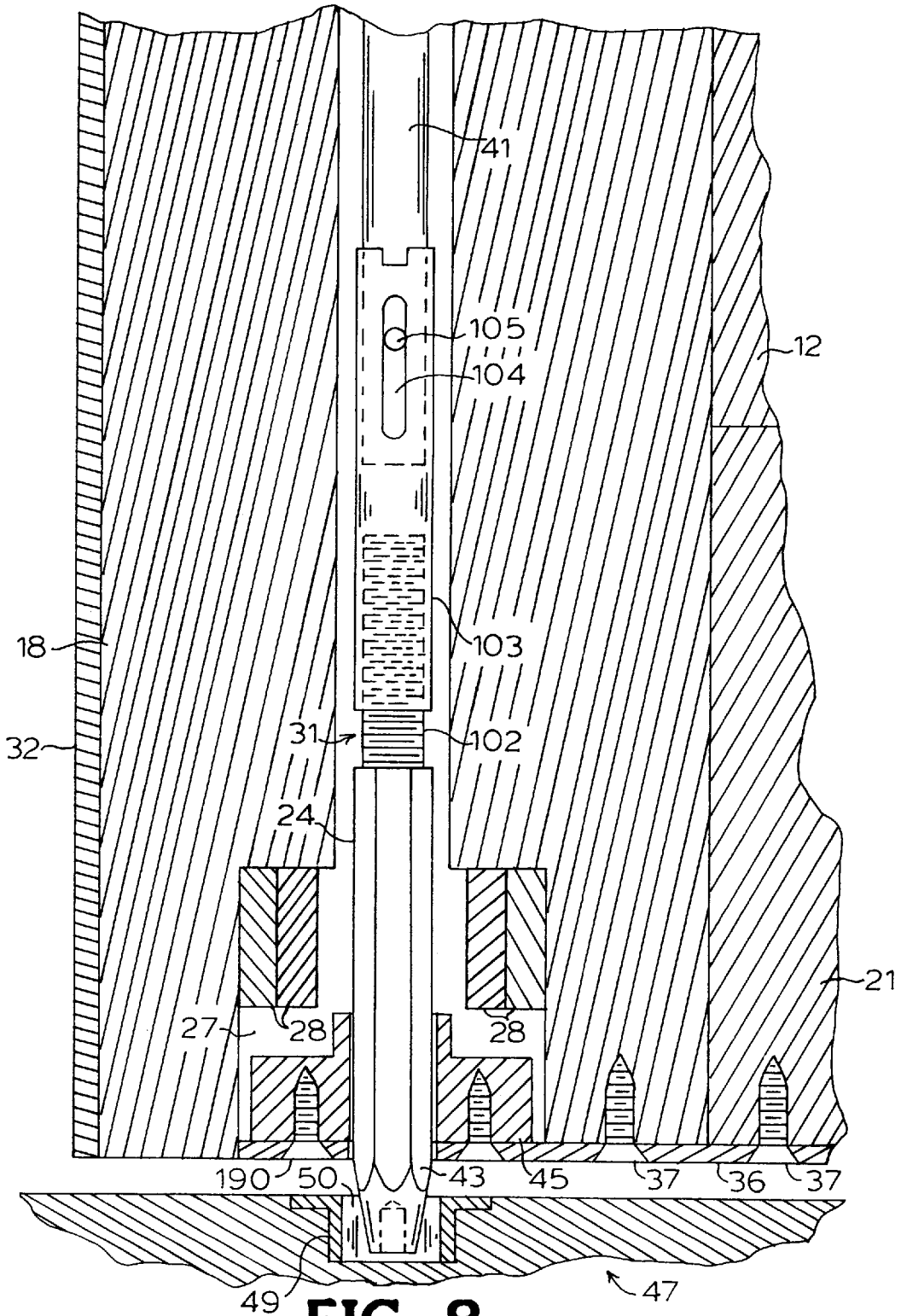
FIG. 8 is a sectional view of an embodiment of another latch for use in the present invention.

Means for sealing the channel 24 under fire conditions is positioned in the channel 24. The sealing means material is fire resistant. Preferably, the sealing means is also intumescent, that is, it expands to several times its original size when heated. There are different types of fire resistant, intumescent material available for use in the latch stile channel 24 of the present invention. For example, a suitable material is Exterdens FA available from American Vamag Company, Inc., of Ridgefield, N.J., U.S.A. Exterdens swells to many times its original volume at high temperature. The sealing means 28 functions to close off the channel 24 during a fire thereby eliminating the chimney effect of the channel 24 through the latch stile 18 and safeguarding the door structure. In other words, the sealing means 28 prevents air from being sucked up into the channel 24 like a flue, and thereby closes off any access for heat and flames to the interior of the door stile, the exit device mechanicals and the internal portions of the door. When the sealing means 28 is intumescent material, the intumescent material 28 is preferably formed into pads of about one inch high by about ⅝ inches wide and about ⅛ inches thick. As shown in FIGS. 3, 5 and 8, the intumescent pads 28 are positioned on either side of the channel 24 at the point the channel expands to accommodate the top and bottom latch assemblies 30, 31. Alternatively, the intumescent material may be formed into a sleeve which fits around the rods 40, 41. In both cases, the intumescent material expands when heated to fill the void in the channel 24 between the channel walls and the rods 40, 41.

Optionally, a tube, not shown, may be positioned within the channel 24 for lining the channel and for housing the exit device elements. Preferably, the tube conforms to the shape of the channel 24 and may extend partially or entirely along the length of the channel 24. The tube may be comprised of metal, plastic, fiberglass, and the like, and the sealing means 28 may be disposed within the tube. Alternatively, the tube itself may be an intumescent material, such as PVC. The tube material should not be combustible nor contribute to flaming by offgasing combustibles which exit the door. The tube offers a low friction surface for operation of the exit device and helps keep dust out of the hardware. When the tube itself is intumescent, swelling during heat conditions aids in the fire retardance of the door 1. A drawback to using the tube is the additional latch stile 18 material that must be removed in order to make the channel 24 big enough to receive both the tube and the exit device hardware therein, thus reducing the thermal resistance of the door. Preferably, therefore, a high fire-rated door would not include a tube.

In carrying out the invention, an intumescent strip 32 may also be located in the outer edge of the latch stile 18. Use of the intumescent strip 32 is preferred for Any fire resistant, intumescent is appropriate for this purpose. One such intumescent material is Palusol 2004 which is available from American Vamag Company, Inc., of Ridgefield, N.J., U.S.A. The intumescent strip 32 expands during a fire sealing the gap between the doors creating a bond and a continuous fire barrier between the two doors that is able to withstand the fire test conditions. To apply the strip 32 to the latch stile 18 edge, a vertical groove 34 is cut into the latch stile 18 edge of the door 1 which is sufficient to accommodate the intumescent material 32 and extending the full length of the door 1. The intumescent strip 32 is then appropriately secured in the groove 34, such as by adhesive. The preferred size of the strip 32 is about 20 millimeters across by about 4 millimeters deep.

The door 1 of the present invention is provided with one or more facing layers secured to the major outer surfaces of the door 1, with at least the outer layer 16 externally identifiable as a wooden facing 16 layer. The term "wooden facing layer" is intended to include many forms of such wood layers used in door constructions, including wood veneer, plywood, medium density overlay, high pressure laminates and the like. Preferably, the door construction of the present invention comprises a wood veneer face having a wood veneer crossband, a layer of veneer running 90° to the face layer for strength. The wooden facing layer 16 not only provides an aesthetically pleasing overall covering of the door faces, but also enhances the door stiffness. The face sheets are typically only about 3/32 to about ⅛ inches thick to form a composite door having an overall thickness of about 1¾ inches when used with a typical core 12 thickness of about 1 ½ inches.

From the description above, it is understood that a principal factor taken into account in choosing the materials for the door 1 construction is the fire rating desired. Of course, in wood fire door applications at least the outer facing 16 layers are normally comprised of thin veneer wood. The outer facing 16 material notwithstanding, it is understood that the core 12 and blocking combination contemplated by the present invention may employ a variety of specific embodiments and, as described above, the present invention provides for a number of choices as to the selection of door materials depending in large part on the desired fire rating.

In the manufacture of the door 1, the blocking is positioned adjacent the edges of the core 12 and secured thereto using any one of several alternative techniques. For example, the blocking 13 can be directly applied to the edge surfaces of the core 12 by an appropriate adhesive. The assembled core and blocking may thereafter be introduced into a sanding or finishing machine. The facing 16 is then adhesively applied to the major faces of the core 12. Optionally, one or more under layers such as crossband, including plastic or wood sheets, are initially applied followed by the wood facing layers 16. The door 1 is directed into a conventional hot or cold press where the face layers 16 are bonded to the core 12 under pressure. Optionally, the blocking need not necessarily be directly bonded to the edges of the core. In this alternative, the core 12 and blocking may be assembled in, for example, a jig and facing 16 adhesively applied over the assembly, the facing 16 serving as a means for retaining the blocking in assembled relation with the core 12. The finished door structure is machined for hardware and is ready for final finishing, packaging and shipping. The above door manufacturing process is commonly used and will be well understood by those skilled in the art.

In keeping with the invention, a bracket 36 can be secured to the top and bottom edges of the latch stile 18. The bracket 36 is either L-shaped or, for higher fire ratings, U-shaped. The bracket is preferably metal, but may be comprised of any material having adequate strength at extreme temperature. The bracket 36 acts to strengthen the door 1 in the area of the upper and lower edges of the latch stile 18. Without the bracket 36, deterioration of the latch stile 18 structure during a fire may result in weakening of the stile 18 until it can no longer contain the exit device hardware during the hose stream. The brackets 36 are mounted flush with the door edge using fasteners, such as screws 37, and extend along a portion of the upper and lower door edges in the direction of the hinge stile 19. When the U-shaped bracket 36 is employed, the depending sides of the bracket carry over across the door edge for stabilizing the door and preventing failure of the exposed face of the door 1 for the duration of the fire test and hose stream.

The exit device of the present invention is generally denoted in FIG. 1 as 110, and is secured to the door by fastening screws passing through the surface of the door and into the material of the blocking 22. The hardware associated with the exit device mechanism for use in the present invention is made of steel or other known metals for door hardware applications. Preferably the exit device 110 is formed with sheet metal components reducing the total metal mass and thereby reducing the heat sink for better door performance. The exit device 110 shown is of the type conventionally referred to as concealed vertical rod. Concealed vertical rod exit devices are well-known in the art and the general operation for use in the present invention does not deviate therefrom. For example, a description of the operation of a concealed vertical rod exit device and mechanicals is disclosed in U.S. Pat. Nos. 5,042,851 and 4,796,931, which are incorporated herein by reference. The features of a concealed vertical rod exit device for use in accordance with the present invention are discussed below.

As shown in FIG. 1, the exit device 110 generally comprises a latch housing 44 including an external actuating mechanism 116. Inside the latch housing 44 and latch stile 18 resides latch retraction means including linkages which communicate the movement of actuating mechanism 116, as would happen when one tries to exit through the door 1, to operate vertically extending rods 40, 41 which connect to upper and lower latch bolt assemblies 30, 31.

The vertical rods 40, 41 are disposed in the channel 24 defined by the latch stile 18. The rods 40, 41 may be any shape suitable for smooth reciprocation in the channel 24, and are typically round. The rods 40, 41 reciprocate in the channel 24 in response to movement of the latch retraction means and thereby translate movement thereof to the mechanisms of the latch bolt assemblies 30, 31. Typically, adjustable mechanisms allow the effective length of the vertical rods 40, 41 to be adjusted so that the rods will operate properly without removing the door 1 from its hinges.

The latch bolt assemblies 30, 31 are normally shaped to cooperatively retain latch bolt mechanisms. In order to maximize the door material through the door face in the area of the latch assemblies 30, 31, the narrowest possible bolt assembly is preferred. As noted above, in keeping with the invention, pockets 26, 27 formed at the upper and lower ends of the latch stile channel 24 receive the latch assemblies 30, 31.

The latch bolt mechanisms generally comprise latch bolts 42, 43. The latch bolts may be any shape or type for use with a concealed vertical rod exit device including reciprocating bolts, standard pullman or pivoting type bolts, gravity bolts mounted in the door frame for extraction by the rod, and the like. As shown in FIGS. 3 and 8, a type of latch bolt suitable for use in the present invention are straight bolts with flat latching surfaces vertically slidable in the upper and lower latch assemblies 30, 31. The bolts 42, 43 are adapted to project from the assemblies 30, 31 and extend beyond the edges of the door. Receiving elements 48, 49 formed with vertical openings 50 are positioned in the door lintel 46 and threshold 47, respectively. In the closed position of the door 1, the receiving elements 48, 49 accept the extended latch bolts 42, 43 thereby securing the door 1 within the plane of the door frame structure. Where a pullman latch is utilized, the beveled ends of the latch bolts ride over the receiving element walls and into engagement with the openings for retaining the door in closed position. Alternatively, the latch mechanism may be the type that rotatably engages a receiving element mounted on the door frame, not shown. The latch is received on a stationary receiving lug mounted to the door frame wherein the latch pivots on the contact with the lug during door closure to the door frame to capture the receiving lug in an automatic fashion. No aperture in the door frame is required for receiving the bolt and such arrangement eliminates the need for a vertically driven latch bolt.

The preferred top latch assembly 30 is shown in detail in FIGS. 3 and 5, comprising a conventional "pancake type" latch. The mechanism fits conveniently into the pocket 26 described above, and operates in the plane parallel to the face of the door 1 to extend and retract the latch bolt 42 in response to vertical movement of the upper rod 40. As described above, the mechanism is very thin in profile maximizing the fire insulating potential of the door 1. For example, the assembly 30 extends about 5 inches into the channel 24 and about 1 ½ inches across the face of the door, but is only about ½ inches deep.

Figure 4:
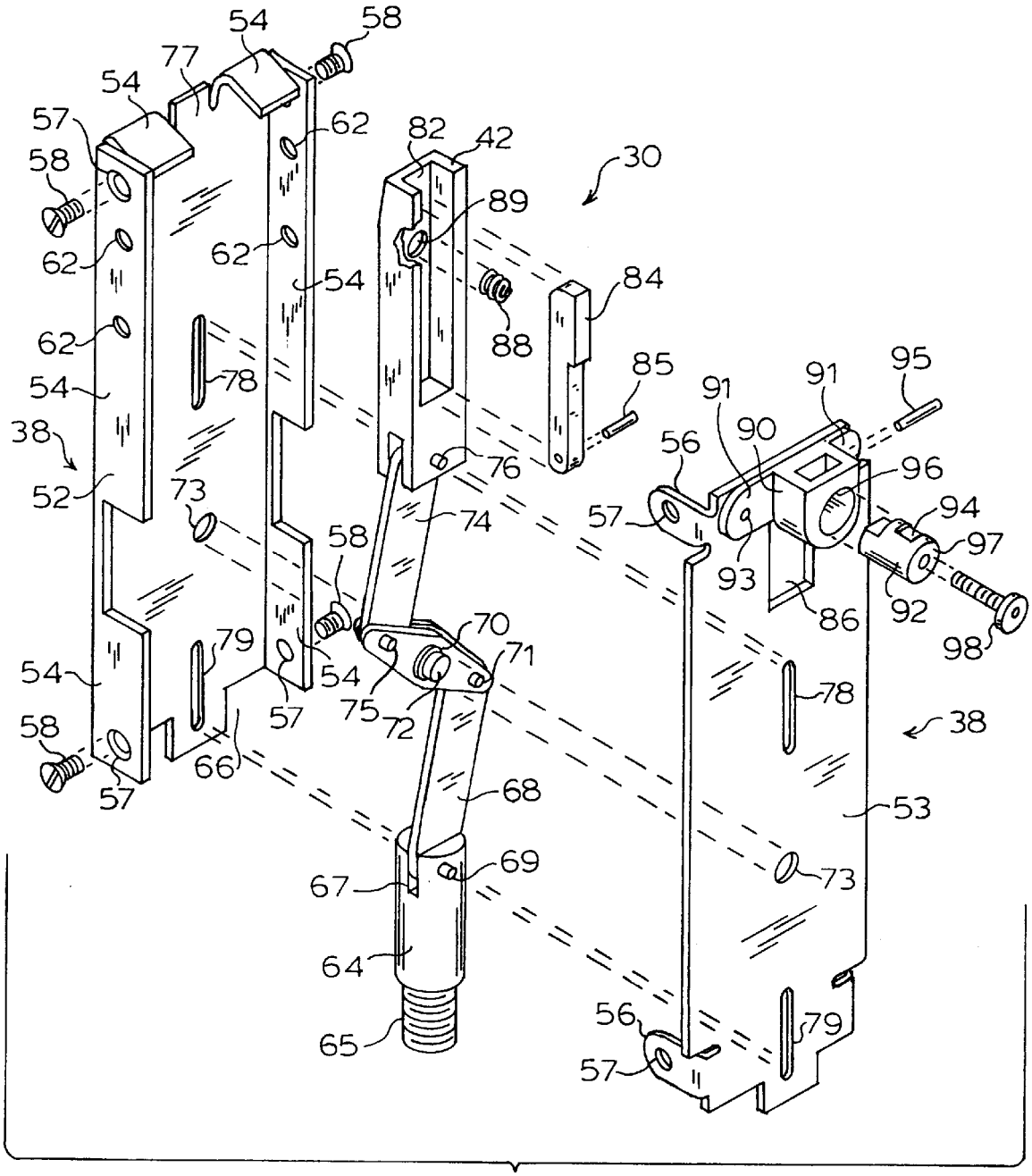
FIG. 4 is an exploded view of the latch as in FIG. 3 for use in the present invention.

Referring now to FIG. 4, the preferred top latch assembly 30 includes two cooperating halves 52, 53. One half 52 is substantially box-shaped having depending sides 54. The other half 53 is substantially flat and includes apertured legs 56 at each corner having holes 57 defined therein. When the top latch assembly 30 is assembled, the inner side of the substantially flat half 53 engages the depending sides 54 of the box-shaped half 52 and the holes 57 internally align with corresponding holes 57 provided in the box-shaped half 52 for receiving fasteners, such as screws 58, for securing the halves 52, 53 together. Angled mounting brackets 60 are provided having one leg securely attached, such as by rivets, to the bracket 36. The mounting brackets 60 have downwardly depending legs which extend down into the upper pocket 26 adjacent the sides of the latch assembly 30. Opposed holes 62 are provided in the mounting brackets 60 and the latch assembly 30 for receiving fasteners 63 and securely mounting the latch assembly 30 to the door structure.

The bolt 42 operating mechanism internal to the top latch assembly 30 comprises a rod adaptor 64, lower link 68, intermediate link 70 and actuating link 74. The rod adaptor 64 is cylindrical and has an externally threaded lower end 65 which projects through an opening 66 in the lower end of the latch casing 38. The rod adaptor 64 threadably receives an internally threaded upper end of the top rod 40. The rod adaptor 64 has a slot 67 defined in its upper end for rotatably receiving the lower link 68 which is connected to the rod adaptor 64 by a pin 69. The upper end of the lower link 68 is rotatably connected by a pin 71 to a first end of the intermediate link 70. The second end of the intermediate link 70 is rotatably secured by a pin 75 to the actuating link 74. The intermediate link is centrally, rotatably secured to the latch housing by a fixed pivot pin 81 the ends of which are received in holes 73 in the halves 52, 53 of the casing. The upper end of the actuating link 74 is rotatably secured by a pin 76 in a slot in the lower end of the latch bolt 42. The pins 76, 79 connecting the rod adaptor 64 and lower link 68 and the actuating link 74 and bolt 40 extend through longitudinal slots 78, 79 in the halves 52, 53 of the casing for restricted linear movement of the adaptor 64 and bolt 40. It is apparent, therefore, that downward movement of the adaptor 64 draws the lower link 68 downward which rotates the intermediate link 70 in a clockwise direction causing the actuating link 74 to move upwardly extending the bolt 42 through a hole 39 in the bracket 36. The bolt 42 is received in the receiving element 48 in the door frame, which is shown as a casting secured by screws 81 in the lintel 46 including a roll pin 80 for reduced frictional movement of the bolt 42. It is understood that retraction of the bolt 42 is effected by upward movement of the upper vertical rod 40 reversing the above described movements of the bolt operating mechanism.

In concealed vertical rod exit devices, the latch bolts are typically continuously biased toward the extended position, either by the weight of the rods or a biasing means. In order to permit the swinging and closing of the door 1, the bolts must be retained in their retracted position until the door 1 is closed whereupon the bolts are released to extend and engage the receiving elements. Conventionally, this is accomplished by some trip-lever mechanism which is cocked by opening the door and is tripped by the last closing movement of the door.

Figure 6:
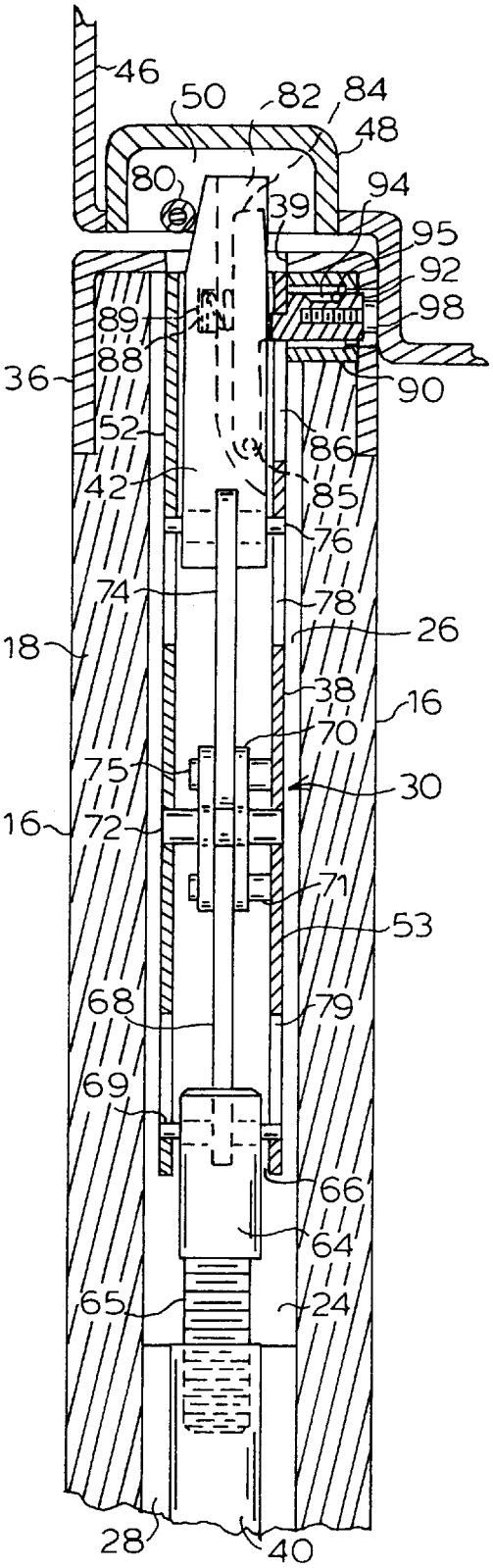
FIG. 6 is a side elevational view in section of the latch shown in FIG. 3 in extended position in the top strike.
Figure 7:
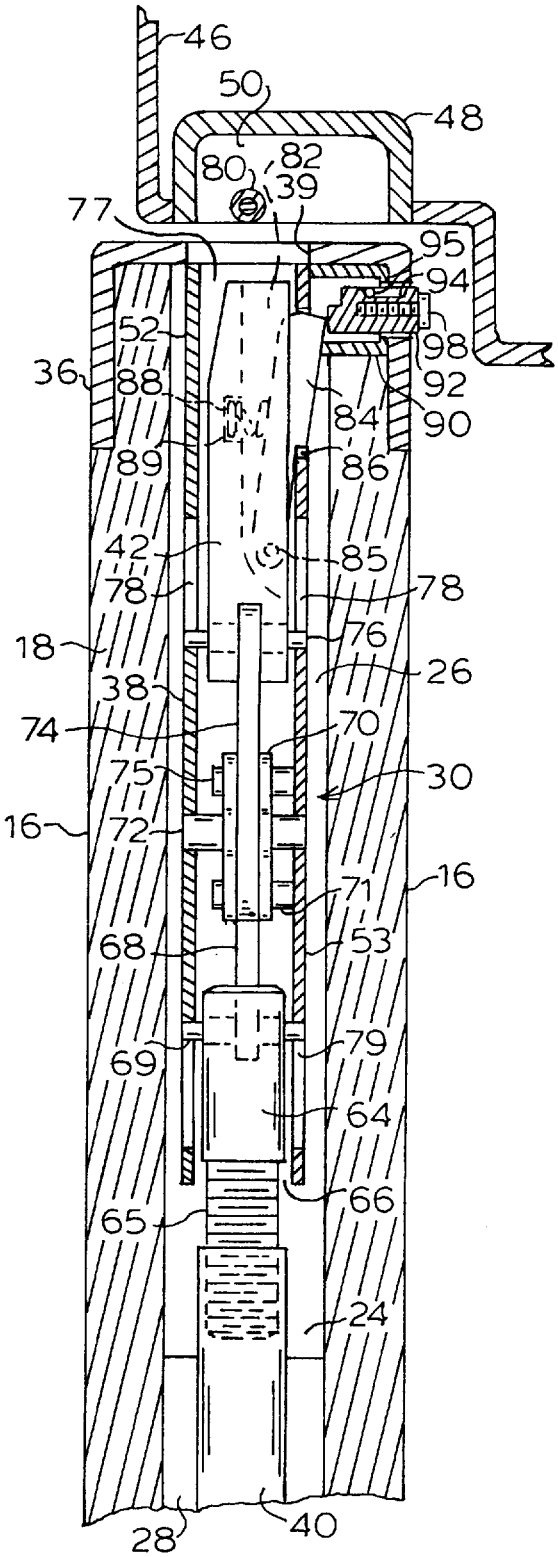
FIG. 7 is a view of the latch as in FIG. 6 with the latch bolt in the retracted position.

Bolt retaining and release means appropriate for use in the present invention are shown in FIGS. 4, 6 and 7. The bolt retaining means comprises a blocking lever 84 pivotally mounted by a pin 85 in a longitudinal slot 82 defined in the bolt 42 and opening toward the frame side of the door 1. The lever 84 and slot 82 are similarly shaped and the width of the slot 82 is slightly greater than the width of the blocking lever 84 for unrestrained pivotal movement of the lever 84. A spring 88 is positioned in a recess 89 in the latch bolt 42 and engages the blocking lever 84. An aperture 86 is defined in the latch casing 38 facing the lever 84. The blocking lever 84 and aperture 86 are so aligned such that when the bolt 42 is retracted, the forward end of the blocking lever 84 is urged out of the slot 82 and into the aperture 86 by the spring 86. The blocking lever 84 thusly engaged in the aperture 86 in the latch casing 38 prevents axial movement of the bolt 42 thereby retaining the bolt in retracted position throughout opening and closing movement of the door. This prevents the need to continuously pressure the exit device actuating means in order to prevent the bolts 42, 43 from interfering with objects such as the ground or the door frame while the door is being opened and returned to the closed position.

The means for releasing the bolt 42 from the retracted position comprises a plunger housing 90 defining an axial hole 96 therethrough and having a mounting flange 91. The plunger housing 90 is positioned over the aperture 86 and secured to the latch casing 38, such as by rivets 93, such that the axial opening 96 provides access through the plunger housing 90 to the aperture 86. A release plunger 92 is reciprocally disposed in the axial hole 96 in the plunger housing 90. The plunger 92 has a notched portion 94, the opposed walls of the notched portion 94 engaging a transverse pin 100 in the housing 90 for defining the range of motion of the plunger 92 in the housing 90. The outer end of the plunger 92 is internally threaded for receiving a threaded cap 98 which extends through an opening in the latch stile 18 and facing 16. Because the plunger housing 90 opens into the casing 38 via the aperture 86, the inner end of the plunger 92 is arranged to align with the blocking lever 84. In operation, as the door is closing, the cap 98 engages the door frame 46 forcing the plunger 92 inward. The plunger 92 engages the underside of the blocking lever 84 urging the blocking lever 84 against the force of the spring 88 out of engagement within the casing aperture 86. Once the blocking lever 84 is out of the aperture 86, the bolt 42 is free to extend upwardly into the receiving element 48 under the biasing force of the exit device. Since the cap 98 and plunger 92 are threadably engaged, the cap 98 may be adjusted for proper contact with the door frame.

The latch assembly 30 may further include a means for deadlocking the latch bolt 42 against manipulation. The deadlocking means shown in FIG. 5 comprises a deadlocking lever 170, a spring 174 and corresponding spring support 172, and a deadlocking opening 180 in the latch casing 30. The deadlocking lever 170 is j-shaped with the angled portion positioned adjacent the deadlocking opening 180. The deadlocking lever 170 includes an angled slot 178 for receiving a pin integral with the actuation link 74. The spring 174 rests on the spring support 172 and telescopes a pin 173 extending axially therethrough. The upper end of the spring 174 telescopes a pin 175 integral with the lower end of the deadlocking lever 170. In this arrangement, it is also noted that a hole 176 in the actuating link 74 for receiving the pin 75 connecting the intermediate link 70 and actuating link 74 is slotted for free play. Thus, if the latch bolt 42 is pressed inwardly from the extended position, the actuating link pin 177 will slide in the deadlocking lever slot 178 rotating the deadlocking lever 174 into the deadlocking opening 180. The angled portion of the deadlocking lever 170 engages in the opening 180 to prevent any further inward movement of the bolt 42. Retraction of the bolt 42 is thereby prevented from the outside. When the exit device actuating means is used to retract the bolt 42, it is apparent that the deadlocking lever 170 is drawn downwardly with the actuating link 74 against the force of the spring 174.

The preferred bottom latch assembly 31 is shown in FIG. 8. The bottom latch assembly 31 comprises a vertical guide member 45 and an adaptor tube 103. The vertical guide member 45 is attached, such as by screws 190, to the bracket 36 and has an axial opening shaped to receive the latch bolt 43 for reciprocation therein. The adaptor tube 103 telescopically receives the lower rod 41 and is secured thereon by means of a transverse pin 105 received in a longitudinal slot 104 in the tube 103. The lower end of the adaptor tube 103 is internally threaded and receives the upper threaded end 102 of the latch bolt 43. When the door is closed, the latch bolt 43 is extended and engaged in a receiving element 49 in the threshold 47. When the exit device actuating mechanism operates the upper vertical rod 40 for retraction of the top latch bolt 42, as described above, it is understood that the lower vertical rod 41 is concurrently raised and the lower latch bolt 43 is retracted permitting the door to be opened. The slot 104 and pin 105 arrangement of the adaptor tube 103 and rod 41 allows the lower latch 43 to be independently moved upwardly into the door 1 so that in case the receiving element 49 which cooperates with the lower latch bolt 43 becomes filled with dirt, a proper functioning of the upper latch bolt 42 will not be interfered with. As with the top latch assembly 30, the bottom latch assembly 31 is of the narrowest possible construction to allow the maximum amount of door insulating material. Preferably, therefore the bolt is only about ½ inch in diameter.

Although representative top and bottom latch assemblies 30, 31 have been shown and described for securing the door in the frame, it is within the scope of the invention to include only one latch assembly or combinations of other types of conventional latch assemblies. In addition, the top and bottom assemblies 30, 31 can be inverted for bottom and top mounting, respectively. In the latter case, a scissor type actuating means for moving the rods 40, 41 in opposite directions would be necessary. The latch bolts may also extend horizontally.

As described above, exit device actuating means are provided for causing operation of the bolts 42, 43. Generally, the actuating means operate via a pivoting link causing vertical reciprocation of the slide bars 40, 41 whereby the bolts 42, 43 are simultaneously extended or retracted. There are numerous types and styles of mechanisms used for operating door latches for retracting the bolts. It is contemplated that the actuating means for use in the present invention may comprise any known exit device actuating means, for example, a key and key cylinder, a knob, a lever handle, a press bar for rapid actuation of the bolts by depressing the press bar to open the door, and the like.

Preferably the actuating means is a press bar mechanism, which is often referred to as a panic exit device. The press bar assembly 110 includes a cover 112, a horizontal channel cover 114, a push plate 116 and a frame end 118. The assembly 110 extends practically across the entire face of the door 1 in the usual manner at a suitable height to be engaged by anyone who would be forced in a panic against the inner face of the door 1. Pressure exerted upon the bar 116 towards the face of the door will cause operation of the latch bolts 42, 43 by moving the rods 40, 41. The panic exit device may further comprise a keyed exterior lock to permit opening of the door from the outside. Conventionally these mechanisms are provided with an exterior lever or knob which is released by operation of the key lock and then may be manipulated to retract the bolts for opening the door. Alternatively, the keyed lock may operate a separate bolt which must be released before the door may be opened by operation of the knob or lever.

Figure 9:
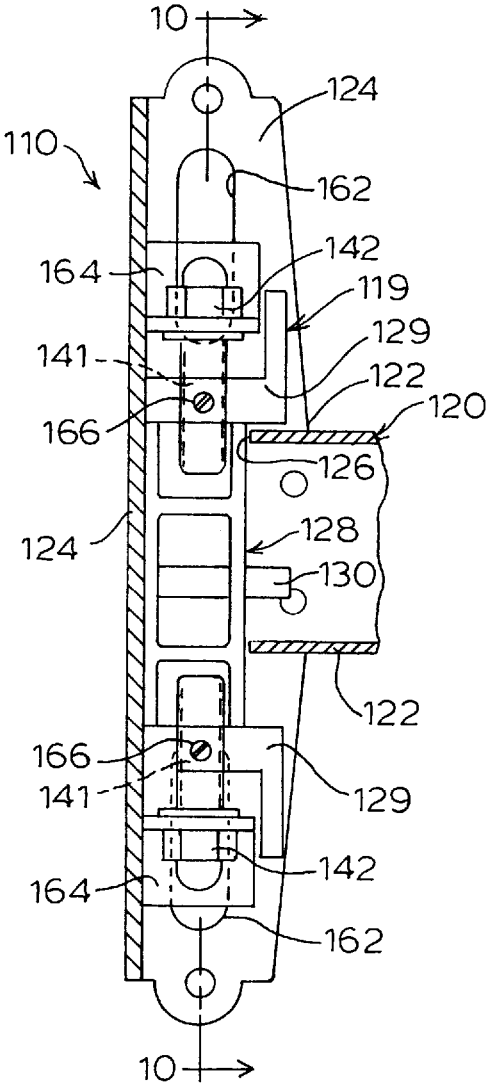
FIG. 9 is an enlarged fragmentary plan view of an embodiment of a latch mechanism with the latch housing removed and with the flanges of the channel 120 partly broken away for improved visibility for use in the present invention.
Figure 10:
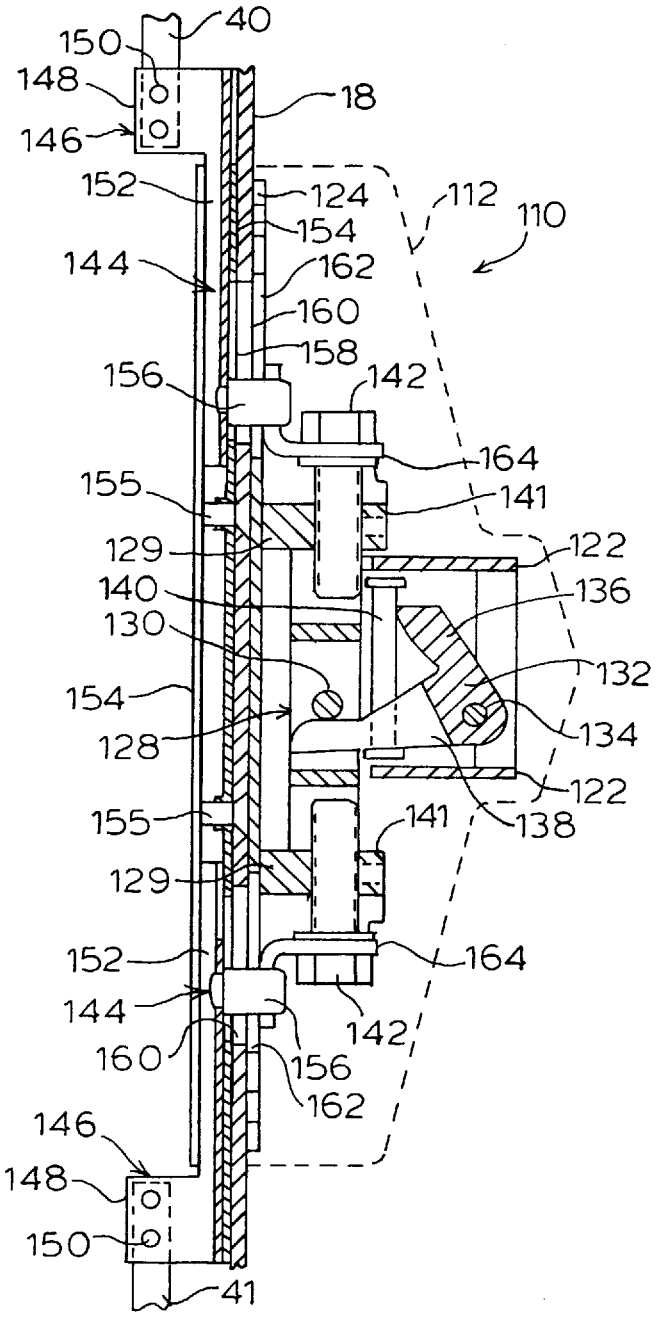
FIG. 10 is a sectional view taken on line 10—10 of FIG. 7 with the cover shown in broken lines.

FIGS. 9 and 10 show a representative press bar exit device mechanism, denoted generally at 110. The mechanism 119 is mounted in a channel 120 which underlies the horizontal channel cover 114. The channel 120 has side flanges 122 and is riveted to a heavy metal angle 124 which forms the base of the mechanism. The flanges 122 are formed with windows 126 in which a rectangular slide 128 vertically reciprocates. The slide is provided with L-shaped end walls 129. An actuator pin 130 is provided and extends between the side walls of the slide 128 and outward from the inner end of the slide 128. As is conventional, the slide 128 is actuated by an L-shaped element 132 which is pivoted on a stationary pin 134 bridged across the top of the latch frame. The shorter leg 136 of the L-shaped element 132 is lifted readily by the cross bar 140 of a latch retractor (not shown). A mechanism linking the push plate 116 to the latch retractor is described in U.S. Pat. No. 4,796,931. The longer leg 138 of the L-shaped element 132 engages under the pin 40 with the result that when the push plate 116 is pushed, the longer leg pivots to raise the pin 130 and hence the slide 128. The L-shaped ends 129 of the slide 128 are apertured and tapped to receive threaded adjustment bolts 142.

The ends of the concealed rods 46, 47 are secured to bracket means 144. The bracket means 144 comprises three elements: (1) an adapter 146 comprising a channel shaped plate 148 which embraces and is secured to the end of the concealed rods by pins 150 and from the plate extends a tail which is received onto the C-shaped tubular element mounted on the inside of the wall of the style by fasteners; (2) to the inner end of the tail 152 is secured a head 156 which extends through openings 158 in the element 154, an opening 160 in the stile 20, and opening 162 in the angle 124 to make the outer end of the head 156 accessible to the outside of the stile 20; and (3) an L-shaped clip 164 is secured to the outer end of the head 156 having a flat horizontal tab which is apertured to receive the shank of the bolt 142 which is rotatable therein.

When the push plate 116 is pressed the element 132 will be rotated clockwise by linkage well known in the art and described in U.S. Pat. No. 4,796,931 so that the long leg 138 will raise the pin 134 and the slide 128 upward. The upper and lower concealed rods 46, 47 which are connected to the bolts 142 bracket means 56 will similarly raise upward. When the push bar 116 is released it will spring out and related linkages will permit the element 132 to rotate back in position. This will permit the pin 134 and slide 128 to drop as will the concealed rods 46, 47. The rods may be adjusted by screwing the bolts 142 inwardly and outwardly in the slide 128 as appropriate. Before and after rotating the bolts 142, set screws 166 will be loosened or tightened as is appropriate.

Once the exit device including the concealed rods is installed and adjusted in the door, the door is hung within any suitable frame by means of hinges along with conventional upper and lower receiving elements, respectively. For double egress and pair doors, the vertical structural elements of a conventional door frame are suitably hinged and the doors are arranged to be swung in the plane of the door frame. The free vertical edges of the doors are disposed in substantially abutting relation for closing the opening defined by the frame.

The previously described versions of the present invention have many advantages, including providing a door having a concealed vertical rod exit device capable of a high fire rating while exteriorly appearing as natural wood. The full length metal channel door edges of conventional fire doors are no longer necessary. The door of the present invention creates a better installation appearance and eliminates objectionable aesthetics of the prior doors. The structural integrity of the door and the exit device housed therein is now maintained using expanding, fire resistant material in the latch stile for sealing the channel and preventing heat and flame from entering the channel and accessing the interior of the door and exit device. This offers the advantage of survival of the door and exit device assembly for a reasonably maximum period of time. Further, because the latch assemblies are adapted to be as narrow as possible, high fire ratings are now possible for 1 ¾ inch doors. One can apply commonly available tools and methods to the working of the materials of the door of the present invention which creates an advantage for manufacturing.

While the present invention has been described in considerable detail in connection with particular versions thereof, other versions are possible. It will be understood, of course, that we do not intend to limit the invention thereto, since modifications may be made by those skilled in the art, particularly in light of the foregoing teachings. On the contrary, we intend to cover all alternatives, modifications and equivalents as may be included within the spirit and scope of the invention as defined by the appended claims. It is, therefore, contemplated by the appended claims to cover any such modifications as incorporate those features which constitute the essential features of these improvements within the true spirit and the scope of the invention. Therefore, the spirit and scope of the appended claims should not be limited to the description of the preferred versions contained herein.

We claim:

1. A fire retardant door assembly, the door assembly comprising:

a. a vertical edge having a concealed vertical channel;

b. a horizontal edge having an opening for the channel, wherein a portion of the channel adjacent the opening is enlarged;

c. a bracket secured to the horizontal edge of the door adjacent the channel opening;

d. an intumescent material disposed in the channel for sealing the channel when the door is subjected to heat;

e. an exit device, the exit device comprising:

a vertically reciprocating rod disposed in the channel, means for actuating the exit device for reciprocation of the rod, and a bolt disposed in the enlarged portion of the channel, the bolt operably connected to the vertically reciprocating rod and moveable in response to movement of the rod from a retracted position within the channel to an extended position beyond the opening; and f. a wooden outer layer provided on a major face of the door, the wooden outer layer forming a substantially continuous surface on the face of the door, whereby the door is externally identifiable as a wooden door, wherein the composition of the door is selected to have a fire rating of at least about 20 minutes.

2. A door as recited in claim 1, wherein the vertical edge is substantially non-metallic.

3. A door as recited in claim 2, wherein the channel is rectangular and the length of the channel in the horizontal plane of the door is less than about 1" and the width of the channel perpendicular to the plane of the door is less than about ¾", and wherein the length of the enlarged portion of the channel is less than about 2" and extends form the opening in the horizontal edge to a depth of less than about 7".

4. A door as recited in claim 2, wherein the channel extends the length of the vertical edge of the door and further comprising a second horizontal edge having an opening for the channel, the channel adjacent and wherein the channel adjacent the second horizontal edge is enlarged for receiving a door latching element of the exit device.

5. A fire door assembly as recited in claim 2, wherein the vertical edge of the door comprises a fire resistant composite material having a width in the plane of the door of at least about 4 inches and wherein the composition of the door is selected to have a fire rating of at least about 90 minutes.

6. A door as recited in claim 2, wherein the door is about 1 ¾" thick.

7. A door as recited in claim 2, further comprising an expanding, fire resistant material mounted to the outer surface of the vertical edge wherein the door is used as a pair door having a fire rating of at least 90 minutes or a double egress door having a fire rating of at least 45 minutes.

* * * * *